United States Patent [19]

Burda

[11] Patent Number: 4,560,110

[45] Date of Patent: Dec. 24, 1985

[54] CURRENT DRAW-ACTUATED HYDRAULIC DRIVE ARRANGEMENT FOR ROTARY SHREDDER

[75] Inventor: Dan S. Burda, Carrollton, Tex.

[73] Assignee: MAC Corporation of America, Grand Prairie, Tex.

[21] Appl. No.: 378,616

[22] Filed: Jun. 17, 1982

[51] Int. Cl.[4] ..... B02C 25/00

[52] U.S. Cl. ..... 241/36; 241/32

[58] Field of Search ..... 241/32, 35, 36

[56] References Cited

U.S. PATENT DOCUMENTS

| | | | |
|---|---|---|---|
| 3,868,062 | 2/1975 | Cunningham et al. | 241/36 |
| 4,034,918 | 7/1977 | Culbertson et al. | 241/36 |
| 4,123,009 | 10/1978 | Kilpinen | 241/36 X |
| 4,452,400 | 6/1984 | Williams | 241/36 |

FOREIGN PATENT DOCUMENTS 2361749 6/1975 Fed. Rep. of Germany .

*Primary Examiner*—Howard N. Goldberg
*Assistant Examiner*—Joseph M. Gorski
*Attorney, Agent, or Firm*—Klarquist, Sparkman, Campbell, Leigh & Whinston

[57] ABSTRACT

A hydraulic drive arrangement for a shear-type shredder includes an electrically operable control circuit, including a jam sensor external to the hydraulic fluid circuit, for sensing jamming conditions in the shredder and reversing the flow in the fluid circuit only when a true jamming condition is sensed. The jam sensor is located in the electrical power circuit to the electric motor driving the hydraulic fluid pump for sensing the load on the motor. An electric discriminator circuit responds to the sensor to distinguish between load changes due to true and momentary jamming conditions in the shredder. An actuator responsive to the discriminator actuates a flow-reversing valve in the hydraulic circuit to reverse fluid flow therein to reverse the shredder and thereby clear the jamming condition. The hydraulic fluid circuit, including a pressure relief valve, and the electric motor, dampen any abrupt changes in load due to momentary jamming conditions in the shredder so that they do not cause the discriminator to actuate the flow-reversing valve.

8 Claims, 5 Drawing Figures

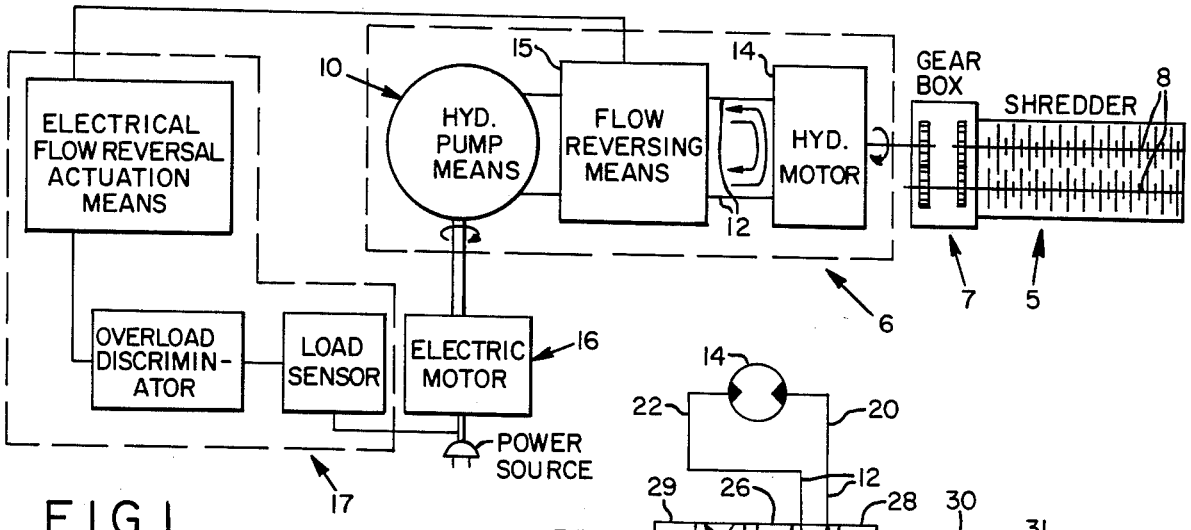
FIG. 1
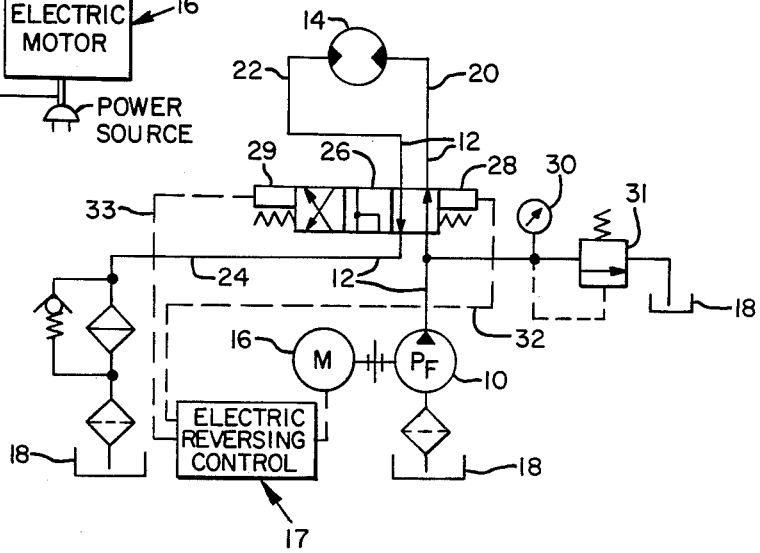
FIG. 2
FIG. 4a
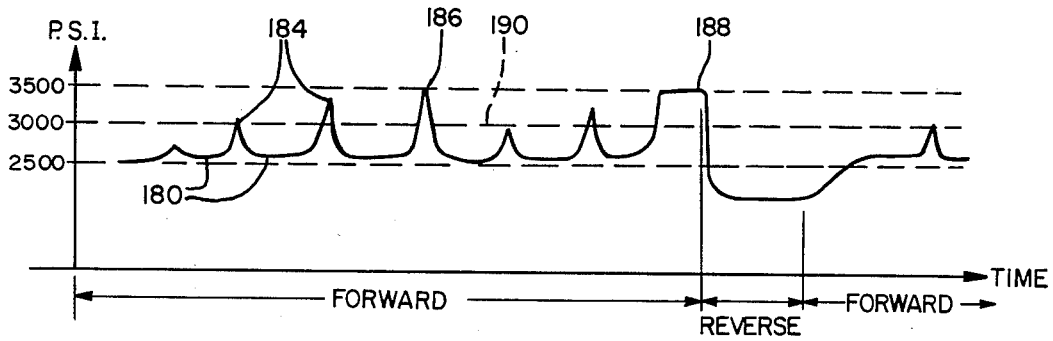
FIG. 4b
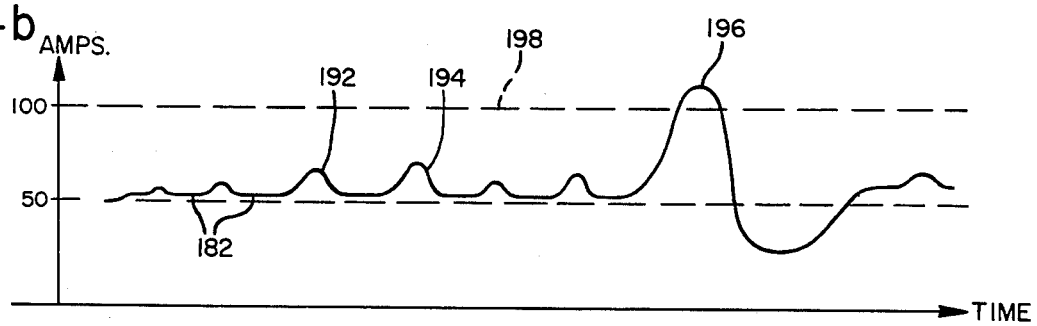

CURRENT DRAW-ACTUATED HYDRAULIC DRIVE ARRANGEMENT FOR ROTARY SHREDDER

BACKGROUND OF THE INVENTION

This invention relates generally to shear type shredders and, more particularly, to automatically reversible hydraulic drive arrangements for such shredders.

Hydraulically driven, shear-type shredders are disclosed in U.S. Pat. No. 3,868,062 to Cunningham, et al. and U.S. Pat. No. 4,034,918 to Culbertson, et al. Prior to the drive arrangements disclosed in those patents, a shear-type shredder was typically driven by an electric motor through a high speed reduction gear train. Any jamming condition occurring in the shredder was transmitted directly to the motor through the gear train. The motor was provided with electric current-sensing and motor-reversing circuitry to detect a jamming condition in the shredder and reverse the electric motor briefly to clear the jam. The arrangement was satisfactory for small shredders having a maximum rating of approximately 20–30 horsepower. By comparison, the high torques required by larger shredders, coupled with frequent jamming and reversing sequences, often caused the electric motors to overheat and burn out.

Accordingly, it was proposed that such shredders be driven hydraulically by interposing a hydraulic pump, motor, and fluid circuit with pressure relief valves between the shredder mechanism and the electric motor. The electric motor would then drive the hydraulic pump. Persons involved in shear-type shredder design believed that this arrangement would effectively isolate the electric motor from excessive torque loads due to jamming conditions in the shredder, and thereby prevent burnout. The earliest hydraulic shredder drive designs employed hydraulic sequencing valves in their hydraulic circuits which both detected jamming conditions upon an increase in hydraulic pressure and briefly actuated a flow-reversing valve in the circuit to reverse the hydraulic motor and thereby clear the jamming condition. This design operated erratically due to both variations in fluid viscosity with temperature and resultant difficulties in determining a consistent reversal pressure threshold.

To correct these problems, as well as others, the aforementioned patents proposed drive arrangements which continued to both sense jamming conditions and actuate a flow reversal means in the hydraulic circuit, but did so with electrical means rather than with hydraulic means. More specifically, those designs employed hydraulic pressure-actuated electric switches, electrically operated pneumatic timers and control relays, and electric reversal solenoids. By electrically sensing overpressures in the hydraulic circuit and electrically reversing the hydraulic shredder motor, the reversing cycle was no longer subject to hydraulic fluid temperature and viscosity variations.

These electric-hydraulic reversing circuits, however, introduced several new problems. One problem was the initiation of unintended reversals when the shredder jammed momentarily on tough or excess material and then cut through the material. Another problem was frequent failure of hydraulic pressure-actuated switches.

Both problems are characterized by momentary pressure spiking in the hydraulic circuit. Due to the relative incompressibility of the fluid, a momentary jamming condition in the shredder causes the pressure in the hydraulic circuit to rise very quickly. When the shredder mechanism breaks through the material being shredded, hydraulic pressure suddenly decreases. This momentary rise and fall in hydraulic pressure forms a pressure spike. Such a momentary jamming condition often causes pressure spikes of sufficient magnitude to actuate the hydraulic pressure switch and thereby initiate a reversing cycle. Even though a true jamming condition had not occurred and reversal subsequently proves unnecessary, the reversing sequence, once initiated, would continue until completion.

Each reversal cycle is about one to three seconds duration. In shredding tough materials, such as truck tires or sheet aluminum, true jamming conditions can occur up to several times a minute but usually occur less often. However, momentary jamming conditions occur more frequently, typically a half dozen or more times a minute. Under these conditions, a significant portion of available shredding time can be lost.

This problem is especially significant in very large, for example, 300–600 horsepower shear-type shredders, not only because of the greater dis-economy of unnecessary reversals, but because such large machines are also more prone to pressure spikes. Small shredder drives use high speed electric or hydraulic motors with reduction gear trains which provide sufficient angular momentum to help cut through tough material and thereby help overcome momentary jamming conditions without initiating unintended reversals. However, very large shredders use high torque, low speed radial piston motors with little or no speed reduction gearing. Hence, they have proportionately less angular momentum to assist in overcoming momentary jamming conditions. Minimal angular momentum is preferred so that the large shredders can reverse quickly without damage to the drive arrangement, but it makes such machines more prone to spiking and, therefore, unnecessary actuation of reversal.

One proposed solution to this problem employs a second timer in the electrical reversing control circuit between the pressure switch and the reversal actuation and timing circuitry. This timer is started when the pressure switch is actuated by either a momentary or a true jamming condition. Upon completion of its timing interval, about one-half second, this timer starts the reversal cycle if the pressure switch is still actuated, indicating a true jamming condition. If the pressure switch is no longer actuated, indicating a momentary jamming condition which has been relieved, the reversal cycle is not started and the shredder continues shredding uninterrupted.

While this approach reduces the amount of unnecessary reversing, it does not prevent overuse of the pressure switches, which causes them to wear out sooner than desired. It has, therefore, been proposed to modify the hydraulic fluid circuit to include fluid accumulators and flow constrictors to filter out pressure spikes due to momentary jamming conditions.

Some improvement in operation was noted, but not enough to enable elimination of the second timer or to prevent premature failure of the pressure switch. In addition, the second timer and added hydraulic components are expensive and unduly increase the complexity of the drive arrangement. It would be preferable to avoid such complexity because of the dirty environment in which such shredders are used and the difficulty of maintaining and adjusting both the hydraulic and electrical control circuits by servicemen without special training. It would also be desirable to avoid relying on failure-prone components, such as pressure-actuated electrical switches.

Accordingly, there remains a need for an improved automatically reversible hydraulic drive arrangement for shear-type shredders.

SUMMARY OF THE INVENTION

A primary object of the invention is to reliably actuate reversal of hydraulically driven shear-type shredders when a true jamming condition occurs but not otherwise.

A second object is to sense jamming conditions in the shredder without reliance on a fluid pressure-actuated electrical switch.

A third object is to simplify the electric-hydraulic reversal control circuitry in hydraulic drive arrangements for such shredders.

Another important object is to minimize the cost and complexity of such circuitry and, accordingly, the skill level required to maintain drive arrangements as aforementioned.

The invention meets the foregoing objects by removing the function of sensing a jamming condition from the hydraulic fluid circuit altogether while continuing to effect reversal within the hydraulic circuit. This function is instead accomplished by sensing the load on the electric motor driving the hydraulic pump. Contrary to the beliefs of those in the shredder art who thought that using a hydraulic motor, pump and fluid circuit isolates the electric motor from the shredder, the electric motor remains sensitive to average loads in the shredder. Increases in loads in the shredder are reflected in increased current or power draw by the electric motor. However, these charges are heavily filtered, or averaged, first, by the hydraulic circuit which contains a relief valve and, secondly, by the momentum and inductance of the electric motor itself. Consequently, momentary jamming conditions which would cause a steep pressure spike are clipped in the hydraulic circuit and then attenuated and smoothed by the electric motor before being sensed by jam-sensing means. They produce at most only a slight increase in power and current draw by the motor and, thus, do not trigger an unintended reversal.

In accordance with these principles, a hydraulic drive arrangement for a shear-type shredder includes an electrically operable control means, including a jam sensor means external to the hydraulic fluid circuit, for sensing jamming conditions in the shredder and reversing the flow in the fluid circuit only when a true jamming condition is sensed. The jam sensor means is located in the electrical power circuit to the electric motor driving the hydraulic fluid pumping means for sensing the load on the motor. Such control means also includes a discriminator means for distinguishing between load changes due to true and momentary jamming conditions in the shredder. Responsive to a true jamming condition is an actuator means coupled to the discriminator means for actuating flow-reversing means in the hydraulic circuit to reverse fluid flow therein between the pumping means and a reversible hydraulic motor means to reverse the shredder and thereby clear the jamming condition. When a momentary jamming condition occurs, the hydraulic fluid circuit, which includes a pressure relief valve, and the electric motor dampen any abrupt changes in load in the shredder so that the load level in the electric power circuit remains well below that corresponding to a true jamming condition. The discriminator means does not respond to variation at this lower level to actuate the flow-reversing means. When a true jamming condition occurs, the average load on the electric motor increases correspondingly, without being appreciably damped out by the fluid circuit and electric motor. This increased load causes the level of the current or power drawn by the motor to increase. When this level exceeds a predetermined threshold, the discriminator means causes electrical reversing control means to actuate the flow-reversing means to reverse the shredder.

The electrically operable control means can include means for filtering the load detection signal from the sensing means. This filtering means can be a time interval measuring means including first and second time delay means. Both time delay means are energized by a load detection signal level over the predetermined threshold, but the second time delay means is not actuated until the time interval determined by the first time delay means expires.

The foregoing and other objects, features, and advantages of the present invention will become more apparent from the following detailed description, which proceeds with reference to the accompanying drawings.

BRIEF DESCRIPTION OF DRAWINGS

FIG. 1 is a block diagram of a hydraulically-driven, shear-type shredder incorporating the present invention.

FIG. 2 is a fluid circuit diagram of the hydraulic drive portion of FIG. 1.

FIGS. 4*a* and 4*b* are illustrative corresponding graphs of hydraulic fluid pressure and current draw in the fluid and electrical circuits, respectively, during operation of the apparatus of FIGS. 1–3.

DETAILED DESCRIPTION OF PREFERRED EMBODIMENT

Overall Arrangement

Figure 3:
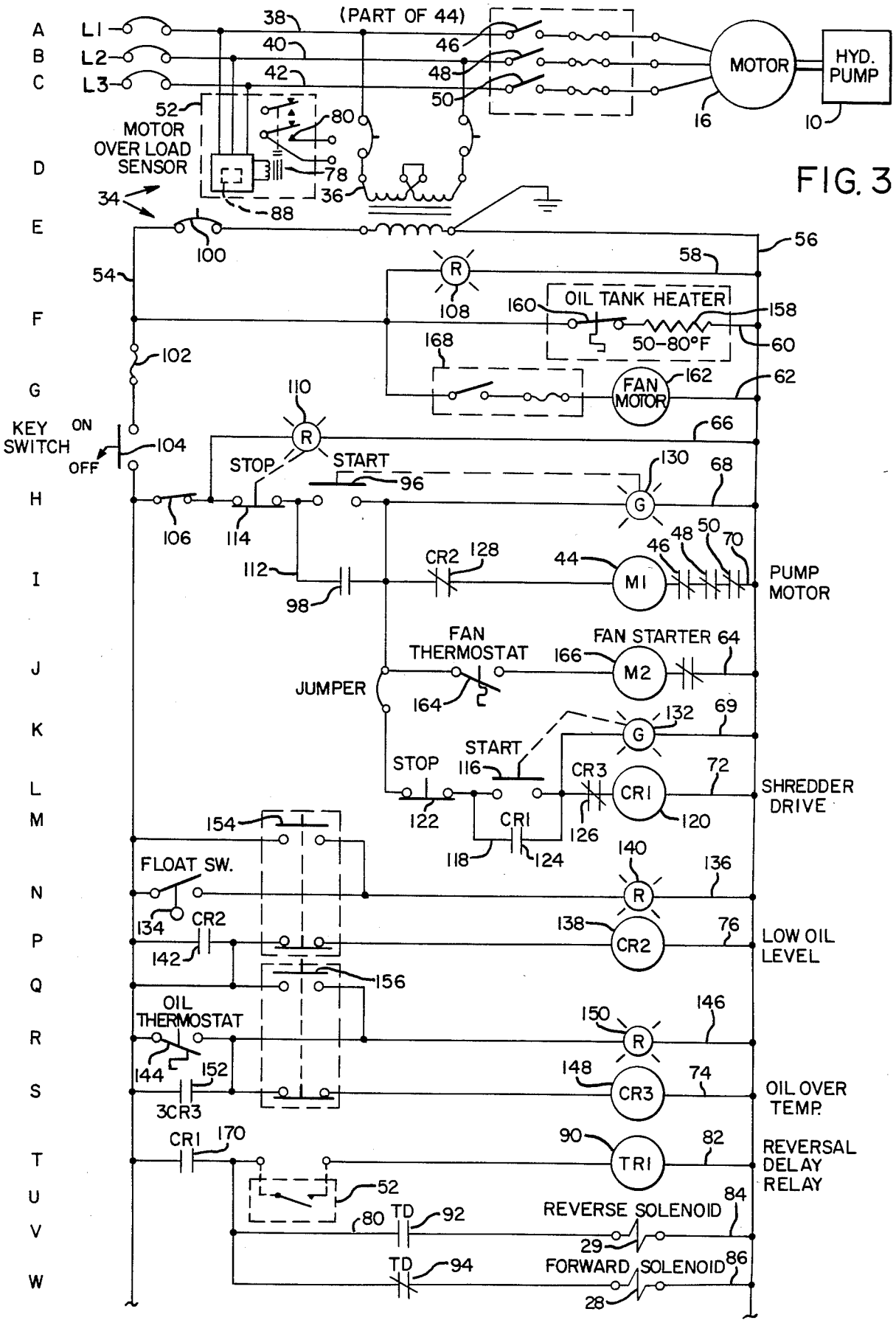
FIG. 3 is an electrical circuit diagram of the shredder, including the electrical reversing control portion of FIG. 1.

In general, the overall structure of a shear-type shredder incorporating the present invention is like that of U.S. Pat. No. 4,034,918, which is incorporated by reference herein. FIGS. 2 and 3 hereof correspond roughly to the left side of FIG. 5 and to FIG. 6 of such patent, with the differences forming the present invention as described below. It should be understood that this invention can also be adapted to the hydraulic circuit of FIG. 4 of U.S. Pat. No. 4,034,918 or the shredder drive arrangement disclosed in U.S. Pat. No. 3,868,062. However, the following description discloses the presently preferred and best mode of the invention.

Referring to FIG. 1, the shear-type shredding mechanism 5 is driven by a hydraulic drive means 6 through a gear train 7 arranged to counterrotate cutter shafts 8 of the shredder at different speeds, for example, 40 and 60 RPM. The hydraulic drive means includes a hydraulic pump 10 which pumps fluid through a fluid circuit 12 to a reversible, high-torque, low speed hydraulic motor 14 and a flow-reversing means 15 for reversing fluid flow in the circuit 12 to reverse the shredder. An electric motor 16 continuously drives pump 10 in one rotational direction during operation. An electrical reversing control means 17 is connected between the power input of electric motor 16 and the flow-reversing means 15. The control means senses loading on the electric motor, discriminates between load changes due to momentary and true jamming conditions in the shredder mechanism and responds to the latter condition to actuate the flow-reversing means, as described in further detail hereinafter.

Hydraulic Drive Arrangement

Referring to FIG. 2, hydraulic pump 10 is preferably a fixed displacement pump which draws hydraulic pressure fluid from a tank 18 and delivers the pressure fluid through hydraulic circuit 12. Hydraulic circuit 12 includes fluid supply line 20 leading to what is normally the intake side of the hydraulic motor 14 and a fluid return line 22 from such motor to a return line 24 leading to tank 18. The flow-reversing means comprises a three-position, open-center, spring-centered four-way valve 26, which is operated by energizing forward solenoid 28 to deliver fluid to drive hydraulic motor 14 in the forward direction and by energizing reverse solenoid 29 to reverse the fluid flow and, hence, the direction of motor 14. As those ordinarily skilled in the art will understand, valve 26 as shown symbolically. It is preferably a master-slave or pilot-operated valve with a choke block or adjustable orifice for controlling the speed at which the slave valve is shifted.

Hydraulic motor circuit 12 also includes a pressure gauge 30 and a high pressure relief valve 31 to bleed fluid from the high pressure line 20 of the fluid circuit into tank 18 whenever the hydraulic circuit pressure exceeds a predetermined upper limit. That limit is set safely below the pressure at which the fluid pump circuit and hydraulic motor might be damaged.

Electric reversing control means 17 is operatively coupled to the power input of electric motor 16 to detect changes in electrical power consumption due to changes in load on the cutter shafts as transmitted through the gear train 7, the hydraulic drive means 6, and electric motor 16 during shredding. Control means 17 provides output signals on control lines 32 to selectively energize valve solenoids 28, 29 for shifting the flow-reversing valve 26 to forward and reverse positions to operate the hydraulic motor 14 in different directions and thereby control the direction of rotation of the interconnected cutter shafts 8. The principle of control means 17 is to automatically actuate a reversal only when power consumption by the electric motor exceeds a threshold indicating a true stoppage or jamming condition in the shredding mechanism.

Electrical Control Circuit

FIG. 3 shows the overall electrical circuit 34 for energizing a three-phase electric drive motor 16 and controlling various functions of the shredder. For clarity, the lines in circuit 34 are identified by letters in the left margin of FIG. 3.

A voltage transformer 36 in line E steps down the primary voltage (440 VAC) for motor 16 to a level (110 VAC) to support the operation of the control portion of circuit 34. The transformer thus divides the circuit into a motor drive portion, above transformer 36, and a control portion, below the transformer. Parts common to both circuit portions are shown in both portions.

The motor drive portion includes primary conductors 38, 40, and 42 (lines A, B, and C) which provide three-phase power to electric motor 16. The control portion includes an electric motor starter 44 (line I). Within each phase conduction path 38, 40, and 42 are thermomechanical transducer switch means 46, 48, and 50, controlled by starter 44. Each switch opens its respective conduction path upon the detection of an increase in current draw in response to a fault within the motor windings associated with that particular phase. Conductors 38, 40, and 42 are monitored by motor load sensing device 52 (line D), which detects an overload condition caused by jamming conditions within the shredder, as hereinafter further described.

The electric control portion of the circuit includes transformer secondary electrical conductors 54 and 56. The control circuit includes a number of subcircuits of conventional design: transformer secondary electric current status pilot light subcircuit 58, oil tank heater subcircuit 60, oil tank radiator fan subcircuit 62 which is thermally actuated in cooperation with fan thermostat subcircuit 64 (line J), power interrupt subcircuit 66, pump motor power-on subcircuit 68, shredder drive power-on subcircuit 69 (line K), hydraulic pump electric motor start-stop relay subcircuit 70, shredder drive start-stop relay subcircuit 72 thermally actuated in cooperation with oil thermostat relay subcircuit 74 (line S) and oil level relay subcircuit 76 (line P). The arrangement and operation of such housekeeping subcircuits will be further described hereinafter.

The control circuit also includes a reversing control subcircuit (lines T, U, V, and W) including electrical relay switch 78 and contacts 80 of load-sensing device 52 (lines D and U), reversal time delay means conductor 82, reverse valve solenoid conductor 84, and forward valve solenoid conductor 86.

1. Reversing Control Subcircuit

The reversing control subcircuit is important to the invention and to the operation of the hydraulic control circuit of FIG. 2. This subcircuit includes motor load sensing device 52. A suitable form of device 52 is a Model 274-A, three-phase AC current monitor, manufactured by Time Mark Corp. of Tulsa, Okla., used in conjunction with appropriate matching current transformers (not shown) from the same source. For example, three Time Mark Model 2768-100 ring-type transformers would be used with a 100 h.p motor having a rating at full load of 96 amps per conductor. Device 54 contains circuitry which senses the electric current and, hence, power, drawn by the electric motor 16 in response to changes in load on the motor and produces a corresponding D.C. voltage output signal. This signal is applied to a voltage comparator (not shown), which provides a load detection signal to the aforementioned electrical relay switch 78 when current exceeds a predetermined threshold. The relay then closes contacts 80 to produce a reversing signal. The relay is spring loaded to automatically reset when current drops below the threshold. This threshold is set by adjusting a comparison voltage in the voltage comparator, which functions in the invention as a part of the discriminator means to produce a reversing signal. Discriminator means can also include an adjustable trip delay means 88, such as a variable R-C circuit at the comparator outputs for delaying application of the load detection signal to relay 78 for a time interval adjustable, for example, between 0.2 and 20 seconds. If motor current drops below the threshold during this interval, the load detection signal drops and the R-C circuit in delay means 88 discharges without tripping relay 78. This feature eliminates any need for a time delay relay. Moreover, it is not usually needed in the present invention, as it is in electric motor direct-drive shredders. In shredding most materials, the electric motor-hydraulic drive arrangement effectively filters out or attenuates any load spikes before they are reflected in a substantially increased current draw by the motor. Therefore, except for especially tough materials, this delay can be set to its minimum time setting.

The discriminator means closes switch contact 80 of motor load sensing device 42 upon the detection of a jamming condition within the shredder. The switch contact's position controls the operation of a reversal time delay means 90 (line T), which is preferably a relay device having two sets of complementary acting contacts 92 and 94. Contacts 92 are normally open and are included in subcircuit 84 while contacts 94 are normally closed and are included in subcircuit 86. Time delay means 90, therefore, is operatively connected to both reverse solenoid 28 in subcircuit 84 and forward solenoid 28 in subcircuit 86. So long as switch contact 80 remains open, time delay means 90 is not activated. During operation under these conditions, the normally closed relay contacts 94 remains closed, thereby energizing forward solenoid 28, and the normally open relay contacts 92 remain open, thereby de-energizing the reverse solenoid 29. The solenoids thus hold valve 26 in a forward flow position for running motor 14 in a forward direction for shredding. When time delay means 90 is activated by the closure of switch contact 80, forward solenoids 28 is de-energized and reverse valve solenoid 29 is energized for the predetermined length of time preset into the time delay means 90, for example, 2–3 seconds. The flow-reversing valve thus shifts to a reverse flow position for that period of time and then automatically returns to the forward flow position to briefly reverse the shredder.

2. Housekeeping Subcircuits and Start-Up

In operation, electric motor 16 is started by depressing momentary start switch 96 of pump motor control subcircuit 68 (line H). This energizes pump motor starter 44 and closes contacts 98 (line I). Contacts 98 electrically connect starter 44 to the secondary voltage of transformer 36, thereby sustaining hydraulic pump motor 16 operation after momentary switch 96 returns to its normal position, provided that the following conditions are satisfied.

Circuit breakers 100 and 102, key switch 104, and valve safety switch 106 are wired in series in conduction path 54 and must be closed to supply the secondary voltage of transformer 36 to start switch 96 (line H). Circuit breaker 100 remains closed as long as the electric current level through the secondary coils of transformer 36 remains below the threshold limit set in the breaker. Red pilot light 108 in subcircuit 58 remains illuminated continuously while electric current is flowing through circuit breaker 100. Circuit breaker 102 monitors the electric current flowing through the entire control circuit with the exception of pilot light subcircuit 58, oil tank heater subcircuit 60, and oil radiator fan subcircuit 62. It remains closed so long as its threshold limit is not exceeded. Key switch 104 is a master control switch which must be set to the "on" position to allow circuit operation of electric circuit 34. Valve safety switch 106 (line H) is a limit switch which remains closed so long as the pressure in the hydraulic lines does not exceed a predetermined threshold above the setting of relief valve 31. Red indicator light 110 in subcircuit 66 remains illuminated continuously while valve safety switch 106 remains closed. If the pressure in hydraulic circuit 12 in FIG. 1 should exceed a predetermined safe level, valve safety switch 106 would open and red indicator light 110 would be extinguished; however, red indicator light 108, which is a pilot indicator for the operational status of the entire control circuit, would remain illuminated.

If the foregoing conditions are satisfied, electric motor 16 starts runing in one direction and continues until motor stop switch 114 is depressed.

Following activation of subcircuit 70 (line I), the closed contacts 98 in subcircuit 112 enable shredder drive start switch 116 in subcircuit 118 (line L). Depressing momentary start switch 116 energizes relay 120, thereby closing contacts 124 in subcircuit 118 (line M) to maintain a control voltage to shredder drive subcircuit 72 until shredder drive momentary stop switch 122 is depressed.

Depressing shredder stop switch 122 disables the shredder drive by removing the drive voltage from relay 120 which, in turn, sustains the open circuit in conductor 72 by opening relay contacts 124. Again depressing start switch 116 restarts shredder operation. Motor stop switch 114 (line H) is essentially in series connection with shredder stop switch 122 through conductor 112 and relay contacts 98. Depressing it thus disables the shredder drive in the same manner as depressing stop switch 114, as well as disabling the pump motor, by removing the drive voltage from starter 44 and opening relay contacts 98. To resume shredder operation, the sequential activation procedure as described above is repeated.

Whenever starter 44 is subcircuit 70 is energized, relay contacts 98 in subcircuit 112 close to illuminate green indicator light 130 (line H) on the control panel to indicate that electric motor 16 is running. Whenever shredder drive relay 120 in subcircuit 72 is energized, relay contacts 124 in subcircuit 118 (line M) close to illuminate green indicator light 132 (line K) on the control panel to indicate that the shredder drive is operational.

Normal shredding operation can be interrupted upon the sensing of either excessive oil temperature or low oil level in tank 18. An excessive oil temperature causes the opening of normally closed relay contacts 126 (line L) in subcircuit 72, thereby disabling the shredder drive. A low oil level causes the opening of normally closed relay contacts 128 (line I) in subcircuit 70, thereby disabling the electric pump motor drive.

Whenever the oil level in the oil tank 18 drops below a safe level, float switch 134 in subcircuit 136 (line N) closes to energize relay 138 in subcircuit 76. Energizing relay 138 opens relay contacts 128 in motor control subcircuit 70 (line I), thereby shutting off pump motor 16, and illuminates red warning light 140 on the control panel and in oil temperature subcircuit 136 by closing relay contacts 142. Adding oil to the oil tank corrects the fault condition, thereby reopening float switch 134 and thus reclosing relay contacts 128 to re-energize electric pump motor 16, extinguish light 140, and enable resumption of shredding.

Whenever the oil temperature exceeds a safe level, oil thermostatic switch 144 in subcircuit 146 (line R) closes to energize relay 148 in subcircuit 74 (line S). Energizing relay 148 opens relay contacts 126 in subcircuit 72, thereby disabling the shredder drive, and illuminates red warning light 150 on the control panel and in subcircuit 146 by closing relay contacts 152. The return to a safe oil temperature tank corrects the fault condition, thereby reopening oil thermostat 144 and thus reclosing relay contacts 126 to re-enable the shredder drive, extinguish light 150, and immediately resume shredding.

The operational status of both low oil red light indicator 140 and oil over-temperature red light indicator 150 can be independently tested. Depressing switch 154 simultaneously opens subcircuit 76 and de-energizes relay 138, thereby deactivating float switch 134 and completing circuit 136 to energize low oil level red warning light 140. Depressing switch 156 simultaneously opens subcircuit 74 and de-energizes relay 148, thereby deactivating thermostatic switch 144 and completing circuit 146 to illuminate oil over-temperature red warning light 150.

The oil temperature in the hydraulic fluid circuit is regulated within a normal operating range by oil tank heater subcircuit 60 and radiator fan subcircuit 62 (lines F and G). When cold, the oil is warmed by oil tank heater 158 to preferably 50°-80° F. to assist in cold starting the shredder. Included in subcircuit 60 is oil thermostatic switch 160 that shuts off the heater 158 when the desired minimum oil temperature is reached. During shredding, the oil is cooled by a radiator and fan driven by single-phase motor 162 in subcircuit 62. When the oil temperature exceeds a predetermined limit, fan thermostatic switch 164 closes to energize fan motor starter 166 in subcircuit 64 (line J), thereby actuating fan motor 162 in subcircuit 62 (line G). Starter 166 includes a thermomechanical transducer switch 168 which opens the drive voltage conduction path 62 upon detecting an excessive current draw due to a fault condition in fan motor 162.

Fan motor starter 166 in subcircuit 64 is enabled by pump motor start switch 96 (line H). The fan thus continues cooling the hydraulic fluid after the shredder drive subcircuit 72 has been disabled by stop switch 122. When an oil over-temperature fault condition closes oil thermostatic switch 144, relay 148 opens relay contacts 126 to disable the shredder drive and enables the continued operation of subcircuits 62 and 64 to air cool the overheated oil.

The de-energizing of shredder drive relay 120 is subcircuit 72, which disables the shredder drive, by either opening relay contacts 126, indicating an oil over-temperature condition, or activating stop button 122, removes the secondary voltage of transformer 36 from the flow-reversing control circuit. Both valve solenoids 28 and 29 are thereby de-energized. The spring centering capability of valve 26 returns the valve spool to a neutral position to stop the shredder drive while continuing to pump fluid through the cooler (not shown) and back to tank 18.

Operation of Automatic Reversing Controls

In operation, electric motor 16 drives pump 10 continuously in one direction to deliver pressure fluid through line 20 to valve 26. At start-up, valve 26 is spring-centered to its neutral position and the fluid passes through the open center of the valve back to the tank via line 24. The shredder drive is actuated by pushing button 116 (line L), causing the normally open relay contact 170 (line T) of relay 120 to close. Closing contacts 170 applies the secondary voltage of transformer 36 through normally closed relay contact 94 to energize forward valve solenoid 28 in subcircuit 86, thereby shifting valve 26 to its forward position. Reverse valve solenoid 29 in subcircuit 84 remains de-energized because the reversal time delay contacts 92 remain open. High pressure hydraulic fluid is thus directed through line 20 to hydraulic motor 14, thereby driving the cutter shafts in their forward directions for shredding material.

Material is then fed into the shredder for shredding in a shearing action between coacting cutter discs mounted on the counterrotating shafts 8. The material resists the torque of the cutter shafts.

This load resistance causes the fluid pressure in line 20 of the hydraulic circuit to rise, for example, to an operating pressure of about 2500 psi, represented in FIG. 4*a* at reference numeral 180. This resistance is transmitted through the pump to the electric motor where it causes a compensating power draw. This power draw is sensed by sensing means 52 as an increase in electrical current in lines 38, 40, 42 of FIG. 3 to an operation current of, for example, 50 amperes, represented in FIG. 4*b* at reference numeral 182.

Intermittently, as the cutters encounter tougher or greater amounts of material, resistance increases, slowing or stopping rotation of the cutter shafts and causing fluid pressure to rise to as much as 3500 psi, the approximate setting of relief valve 31 (FIG. 2). If the cutters then break through the material, the pressure drops, forming pressure spikes 184, 186, as shown in FIG. 4*a*. If a true jamming condition occurs, the fluid pressure increases to the setting of the relief valve and remains at a plateau 188, as shown in FIG. 4.

In the aforementioned Culbertson, et al, and Cunningham, et al. designs, any pressure spikes exceeding a threshold 190, for example, 3200 psi, would actuate an electrical pressure switch in the fluid circuit, initiating a reversal cycle even though a true jamming condition had not occurred. However, they do not do so in the present invention. The highest such spikes 186 are clipped, and thereby attenuated, by the action of the relief valve 31 bleeding fluid back to tank 18. The high rotational momentum and electrical inductance of the electric motor further dampen the spikes. As a result, short duration fluid pressure spikes 184, 186 appear only as small surges 192, 194 of, for example, 60 to 70 amperes in current drawn by the electric motor, as shown in FIG. 4*b*. Only when fluid pressure reaches plateau 188 (FIG. 4*a*) and remains there does the added load appreciably slow the electric motor. This action causes current amplitude to the motor to increase substantially relative to normal operating current levels, for example, to 100 amperes, as indicated at reference numeral 196 in FIG. 4*b*.

Rather than a pressure switch in the fluid circuit, as in the prior art, the present invention utilizes the aforementioned load-sensing means 52 in the electric motor power circuit, apart from the fluid circuit. The relay and trip contacts 78, 80 of sensing means 52 are set to trip at a current threshold 198. This threshold is set just below the current draw 196 characterizing a true jamming condition, for example, at 100 amperes. Hence, threshold 198 is well above the amplitude of most current surges 192, 194 occasioned by momentary jamming conditions.

The fluid circuit, electric motor, and sensing means thereby cooperate to discriminate between momentary and true jamming conditions. Hydraulic pressure switches, fluid accumulators, and extra delay timers become unnecessary. The relief valve can be set to lower pressures than in prior systems, without interfering with reversal. On the contrary, doing so improves the spike filtering ability of the hydraulic circuit. As an added benefit, it reduces the peak pressures in the hydraulic fluid circuit, reducing the risks of seal failures and hydraulic component damage.

When the current-sensing circuitry in device 52 detects a current amplitude above the predetermined threshold level corresponding to a true jamming condition, it transmits a signal to actuate relay switch means 78. As mentioned above, the load sensing device 52 may include a trip delay means 88, which delays the closure of switch contact 80 until a first time delay interval, for example, 0.2 seconds, has elapsed. Whenever the excessive load electric current persists beyond the first time delay interval, switch contact 80 closes to actuate the flow-reversing circuit. This delay action technique serves as an electrical discriminator for distinguishing spurious responses by sensing device 52 corresponding to electric current glitches and momentary interruptions in the shredding process, caused by the introduction of especially difficult to shred objects, from a jamming condition requiring reversal of the cutting mechanism.

The closure of switch contact 80 activates the reversing time delay relay 90 in subcircuit 82, to actuate flow reversal in hydraulic circuit 12 in FIG. 1. Energizing time delay relay 90 simultaneously opens relay contacts 94 in subcircuit 86, thereby de-energizing forward solenoid valve 28, and closes relay contacts 92 in subcircuit 84, thereby energizing reverse valve solenoid 29. Reverse valve solenoid 29 shifts flow-reversing valve 26 to the reverse position for reversing the fluid flow to motor 14, thereby reversing such motor. Reversal of motor 14 reverses the counterrotation of the cutter shafts, disgorging material upwardly from between such shafts to relieve the jamming condition. Once the current level returns to a value sufficient to deactivate motor load sensing device 52, thereby causing relay contacts 92 to reopen, time delay relay 90 is de-energized but continues timing.

After a predetermined time period determined by the time delay setting of relay 90, relay contacts 92 reopen, thereby de-energizing reverse valve solenoid 29, and relay contacts 94 reclose, thereby re-energizing forward valve solenoid 28. High pressure fluid from pump 10 is again directed through line 20 of hydraulic circuit 12 to cause drive motor 14 to resume rotating in the forward direction to drive the cutter shafts in their shredding directions.

If, after reversal, the electric current level as detected by motor load sensing device 52 again exceeds the threshold current level, the foregoing reversal cycle is repeated and continues so long as the true jamming conditions persist.

Having described and illustrated the principles of my invention in a preferred embodiment, it should be apparent that it may be modified in arrangement and detail without departing from such principles. I claim all modifications coming within the scope and spirit of the following claims.

I claim:

1. A drive arrangement for a shear-type shredder, comprising:

a hydraulic fluid-pumping means;

driving means for unidirectionally driving the hydraulic fluid-pumping means;

a reversible hydraulic motor means for bidirectionally driving a rotary cutter shaft in a shredder, rotation of the shaft being subject to changes in load due to variations in shredding conditions in the shredder;

a hydraulic fluid circuit means including the hydraulic fluid-pumping means and the reversible hydraulic motor means for transmitting power in a downstream direction from the driving means to the motor means and transmitting said changes in load upstream via the motor means to the driving means, the driving means being responsive to an increase in load to increase the power supplied to the pumping means;

a flow-reversing means to reverse a fluid flow in the hydraulic circuit from the pumping means to the hydraulic motor means;

electrically operable reversing control means for actuating the flow reversing means upon detecting an increase in load due to a jamming condition in the shredder including:

sensing means, connected to the driving means upstream of the fluid circuit means, for sensing power supplied to the pumping means and responsive to an increase in power supplied to the pumping means above a predetermined limit to produce a reversing signal; and means responsive to said reversing signal to actuate said flow-reversing means for a period of time briefly to reverse the direction of rotation of said shaft and thereby clear the jamming condition.

2. A drive arrangement according to claim 1 in which the driving means is a high speed electric motor operable to draw a first level of power during normal shredding conditions and responsive to an increase in load transmitted from the cutter shaft through the hydraulic fluid circuit means to the electric motor to draw a second increased power level, the sensing means is selectively responsive only to the second power level to produce said reversing signal, and the electric motor includes means for providing a rotational momentum under normal operating conditions for maintaining rotational speed thereof during momentary jamming conditions so that the motor draws less than said second level of power and thereby avoids causing the sensing means to respond thereto.

3. A drive arrangement according to claim 2 in which the hydraulic fluid circuit means includes means for suppressing transmission of transitory increases in load due to momentary jamming conditions from the cutter shaft through the fluid circuit means to the electric motor to assist the sensing means in differentiating between true and momentary jamming conditions.

4. A drive arrangement according to claim 2 including a pair of said shafts, said reversible motor means including a low speed, high torque hydraulic motor and a low inertia gear train counterrotating said shafts at different speeds.

5. A drive arrangement according to claim 1 including means in the hydraulic fluid circuit for damping transmission to the driving means of transitory increases in load due to momentary jamming conditions and rotating means in the driving means having a rotational momentum such that any transitory increases in load transmitted through the hydraulic fluid circuit are further damped so as not to be sensed by the sensing means and thereby actuate a reversal only upon occurrence of a true jamming condition.

6. A drive arrangement according to claim 5 in which the hydraulic fluid circuit includes a pressure relief valve for attenuating pressure spikes in the fluid circuit due to momentary jamming conditions, prior to the sensing means sensing said conditions.

7. A drive arrangement according to claim 5 in which the hydraulic motor means is a low speed high torque hydraulic motor rotating said shaft through a low inertia rotational drive train.

8. A drive arrangement according to claim 1 including means for filtering out transitory changes in load due to momentary jamming conditions in the shredder as said load changes are transmitted to the driving means so as to minimize the increase in power supplied in response thereto by the driving means and thereby aid the sensing means in discriminating between momentary and true jamming conditions to avoid producing reversing signals in response to momentary jamming conditions.

* * * * *

UNITED STATES PATENT AND TRADEMARK OFFICE

CERTIFICATE OF CORRECTION

PATENT NO. : 4,560,110

DATED : December 24, 1985

INVENTOR(S) : DAN S. BURDA

It is certified that error appears in the above-identified patent and that said Letters Patent is hereby corrected as shown below:

Filed: "Jun. 17, 1982" should be --May 17, 1982--;

Column 1, line 57, "reversing" should be --reversal--;

Column 4, line 4, after "lower" insert --load--;

Column 5, line 26, "as" should be --is--;

Column 7, line 10, "42" should be --52--;

Column 7, line 19, "28" should be --29--;

Column 7, line 23, "remains" should be --remain--;

Column 7, line 30, "solenoids" should be --solenoid--;

Column 8, line 33, "44 is" should be --44 in--;

Column 9, line 43, "is" should be --in--.

Signed and Sealed this

*Twenty-fifth* Day of *February 1986*

[SEAL]

*Attest:*

DONALD J. QUIGG

*Attesting Officer* *Commissioner of Patents and Trademarks*